US006707250B2

(12) United States Patent
Okano et al.

(10) Patent No.: US 6,707,250 B2
(45) Date of Patent: Mar. 16, 2004

(54) GAS DISCHARGE DISPLAY DEVICE, PLASMA ADDRESSED LIQUID CRYSTAL DISPLAY DEVICE, AND METHOD FOR PRODUCING THE SAME

(75) Inventors: Kiyoshi Okano, Nara (JP); Yoshihiro Kanno, Gifu (JP); Yoichi Morita, Gifu (JP); Takahiro Togawa, Gifu (JP); Hirohito Komatsu, Gifu (JP); Masatake Hayashi, Gifu (JP); Atsushi Seki, Tokyo (JP)

(73) Assignees: Sharp Kabushiki Kaisha, Osaka (JP); Sony Corporation, Tokyo (JP)

( * ) Notice: Subject to any disclaimer, the term of this patent is extended or adjusted under 35 U.S.C. 154(b) by 153 days.

(21) Appl. No.: 09/875,260

(22) Filed: Jun. 7, 2001

(65) Prior Publication Data

US 2002/0036465 A1 Mar. 28, 2002

(30) Foreign Application Priority Data

Jun. 14, 2000 (JP) ..... 2000-177750
Jun. 4, 2001 (JP) ..... 2001-167638

(51) Int. Cl.[7] ..... H01J 17/06; H01J 14/49
(52) U.S. Cl. ..... 313/582; 313/491; 349/32
(58) Field of Search ..... 313/582, 585, 313/586, 587, 485, 491, 346 R; 345/60; 349/32; 445/24, 46

(56) References Cited

U.S. PATENT DOCUMENTS 4,599,076 A * 7/1986 Yokono et al. ..... 445/24
4,798,994 A * 1/1989 Rijpers et al. ..... 313/478
5,068,568 A * 11/1991 de Vrieze et al. ..... 313/474
5,541,479 A * 7/1996 Nagakubo ..... 313/586
5,714,841 A * 2/1998 Miyazaki ..... 313/585
5,747,932 A * 5/1998 Hayashi et al. ..... 313/582
5,783,906 A 7/1998 Moore et al.
6,344,713 B1 * 2/2002 Awaji et al. ..... 313/582

FOREIGN PATENT DOCUMENTS

JP 6-333503 12/1994
JP 9-311647 12/1997

* cited by examiner

*Primary Examiner*—Ashok Patel
*Assistant Examiner*—Karabi Guharay
(74) *Attorney, Agent, or Firm*—Nixon & Vanderhye P.C.

(57) ABSTRACT

A liquid crystal cell substrate 109, a plasma cell substrate 104, a dielectric layer 103 provided between the liquid crystal cell substrate 109 and the plasma cell substrate 104, a liquid crystal layer 110 provided between the liquid crystal cell substrate 109 and the dielectric layer 103, and a plurality of plasma channels 106 provided between the dielectric layer 103 and the plasma cell substrate 104, are provided. Each of the plurality of plasma channels 106 includes a discharge gas, an anode 107 and a cathode 108, and the cathode 108 includes a cathode layer 108*a* made of a mixture of a conductive material and an insulative material including a glass having a lead weight percentage of 30% or less.

8 Claims, 8 Drawing Sheets

GAS DISCHARGE DISPLAY DEVICE, PLASMA ADDRESSED LIQUID CRYSTAL DISPLAY DEVICE, AND METHOD FOR PRODUCING THE SAME

BACKGROUND OF THE INVENTION

1. Field of the Invention

The present invention relates to a gas discharge display device, a plasma addressed liquid crystal display device, and a method for producing the same, and more particularly to a gas discharge display device and a plasma addressed liquid crystal display device having a particular discharge electrode, and a method for producing the same.

2. Description of the Background Art

Plasma addressed liquid crystal display devices (PALCs) have been developed aiming to realize large-sized thin flat displays. A PALC is a liquid crystal display device having a structure in which a liquid crystal cell and a plasma cell are layered together via a dielectric layer therebetween, in which picture elements are switched by using plasma channels. A PALC can be made in a large size and produced at a low cost as compared to a liquid crystal display device using TFTs (Thin Film Transistors).

A plasma cell includes a plasma cell substrate and a dielectric layer, with a plurality of partition walls being arranged therebetween in a stripe pattern. Note that the dielectric layer also functions as a part of the liquid crystal cell. A plasma channel is defined as a space sealed by adjacent partition walls, the plasma cell substrate and the dielectric layer, and the plasma channel is filled with a discharge gas capable of being ionized through discharge. Each of the plasma channels has discharge electrodes (an anode and a cathode) formed on the plasma cell substrate, and the discharge gas is ionized into a plasma state by applying a voltage to the discharge electrodes. This phenomenon is called "plasma discharge".

A liquid crystal cell includes a liquid crystal cell substrate and the dielectric layer, with a liquid crystal layer being interposed therebetween. On the liquid crystal layer side of the liquid crystal cell substrate, a plurality of signal electrodes in a parallel stripe pattern are formed so as to cross the plasma channels. Moreover, the liquid crystal cell substrate includes, on the liquid crystal layer side, colored layers provided so as to correspond to the signal electrodes. The colored layers are typically red, green and blue layers.

In a PALC, each region at an intersection between a signal electrode and a plasma channel defines a picture element region. The liquid crystal layer in each picture element region changes its orientation according to the voltage applied between the signal electrode and the plasma channel, whereby the amount of light passing through the picture element region changes. An image signal is applied through the liquid crystal layer in each of the picture element regions arranged in a matrix pattern, so as to control the amount of light passing through the picture element region, thereby displaying an image. In the present specification, the minimum unit of display is referred to as a "picture element", and each region of the liquid crystal display device corresponding to a "picture element" is referred to as a "picture element region".

A PALC operates as follows, for example, with the plasma channel being the row scanning unit and the signal electrode being the column driving unit.

A line sequential scanning operation is performed by successively and selectively turning the plasma channels into a plasma state by rows. In synchronism with this, a driving voltage is applied to each of the signal electrodes forming the column driving unit. Since a plasma channel selectively turned into a plasma state is filled with an ionized discharge gas, the potential of the plasma channel turned into a plasma state, except for the vicinity of the cathode, is substantially equal to the potential of the anode. Therefore, an amount of charge according to the difference between the potential of the plasma channel and the potential of the driving voltage is induced/stored in the bottom surface of the dielectric layer (the surface on the plasma channel side; hereinafter referred to as the "dielectric layer bottom surface") located between the plasma channel turned into a plasma state and the signal electrode opposing the plasma channel. At this time, the liquid crystal layer in the picture element region defined by a region where the plasma channel turned into a plasma state and the signal electrode to which the driving voltage is applied intersect each other changes its orientation according to a voltage obtained by capacitance division of the voltage applied to the plasma channel and the signal electrode between the dielectric layer and the liquid crystal layer.

Then, when the plasma channel is de-selected (when the plasma discharge is stopped), the inside of the plasma channel is insulated, and the state where the charge is stored in the dielectric layer bottom surface is maintained until the plasma channel is selected again to be turned into a plasma state. In other words, the potential difference (voltage) between the dielectric layer bottom surface and the signal electrode is sampled and held by the capacitance formed by the dielectric layer bottom surface, the dielectric layer, the liquid crystal layer and the signal electrode. As a result, while the inside of the plasma channel is insulated, the orientation of the liquid crystal layer in the picture element region is maintained by the sampled and held voltage.

As described above, the plasma channel functions as a switching element for controlling the electrical connection/disconnection between the dielectric layer bottom surface and the anode. Moreover, the dielectric layer bottom surface also functions as a virtual electrode. Of course, the rows and columns may be reversed, in which case the anode of the plasma channel is used as the driving unit by applying a driving voltage thereto, and the signal electrode is used as the scanning unit by applying a scanning voltage thereto.

The plasma discharge occurring in a plasma channel is initiated as follows. When a voltage is applied between an anode and a cathode, electrons emitted from the cathode are accelerated by an electric field between the anode and the cathode to collide with molecules of the discharge gas filled in the plasma channel while traveling toward the anode. As a result, the molecules of the discharge gas are excited or ionized to produce excited atoms, cations and electrons. The cations produced by ionization travel toward the cathode, and some of the cations collide with the cathode to produce secondary electrons. A plasma discharge is initiated by the synergistic effect of the ionization of the discharge gas by the electrons and the discharge of the secondary electrons by the cations. Note that the surface of the cathode contributing to the secondary electron emission will be referred to as a "cathode layer", and the rest of the cathode excluding the "cathode layer" will be referred to as a "lower cathode layer".

While nickel is often used in the prior art as a material of the cathode layer, nickel is easily sputtered during a plasma discharge due to a high sputtering rate (the number of atoms sprung out of the cathode material when a single ion of the discharge gas collides therewith) of nickel, thereby causing the following two problems. One is the sputtered nickel atoms being attached to the plasma cell substrate and/or the dielectric layer bottom surface, thereby reducing the transmittance, and the other is the conductive nickel atoms being attached to the dielectric layer bottom surface along the cathode layer extending in parallel to the direction in which the plasma channels extend, thereby causing a phenomenon called "busbar phenomenon".

The busbar phenomenon will now be described. For example, a case where a color display is produced by using three contiguous picture element regions (respectively corresponding to red (R), green (G) and blue (B)) along a single plasma channel will be described. When only the center, green picture element region is turned ON (bright state), a predetermined amount of charge is induced in a region of the dielectric layer bottom surface corresponding to the green picture element region. However, if a conductive substance is attached to the dielectric layer bottom surface along the cathode layer, the induced charge diffuses in a direction along the cathode layer via the conductive substance to be distributed in regions of the dielectric layer bottom surface corresponding to the adjacent red and blue picture element regions beyond the region of the dielectric layer bottom surface corresponding to the green picture element region. Therefore, portions of the liquid crystal layer in the adjacent red and blue picture element regions change the orientation thereof by being influenced by the electric field (voltage) caused by the diffused charge. As a result, while only the green picture element region is supposed to be observed to be ON (bright state) with the adjacent red and blue picture element regions being OFF (dark state), portions of the red and blue picture element regions adjacent to the green picture element region, which is ON, are observed to be ON. Thus, a green color that is supposed to be displayed is mixed with a red color and a blue color, thereby reducing the color purity. As described above, a conductive substance attached to the dielectric layer bottom surface causes color mixture and reduces the display quality.

When nickel is used as the cathode layer, mercury is contained in the discharge gas in the prior art in order to ensure a sufficient product lifetime. While the mechanism by which mercury contributes to preventing the sputtering of the cathode layer has not yet been elucidated, it is presumed that a gas cloud of mercury covers the surface of the cathode layer, thereby absorbing the kinetic energy of discharge gas ions, and even if nickel is sputtered, the nickel atoms return to the surface of the cathode layer through collision with mercury atoms.

As described above, mercury contributes to preventing the sputtering of nickel. However, since the density of the mercury gas cloud depends upon the saturated vapor pressure, and the saturated vapor pressure has a logarithmic temperature dependency (according to the Rankine-Dupre's formula), the sputtering preventing effect of mercury may not be expressed sufficiently in a low temperature region.

In view of this, the present applicant has proposed lanthanoid boride materials as a material of a cathode layer of a PALC (Japanese Patent Application No. 11-003543). For example, lanthanum hexaboride is used as a thermoelectron source of a scanning electron microscope, and is widely known as a substance having a good endurance. Gadolinium hexaboride, as lanthanum hexaboride, is a material having a good electron emission property since it has a small work function, and is suitable as a material of a cathode layer of a PALC. Since these materials have a smaller sputtering rate than nickel, the reduction of transmittance and the busbar phenomenon are less likely to occur even without filling a mercury gas, whereby it is possible to ensure a sufficient product lifetime even at low temperatures.

As the process of forming the cathode layer of a PALC, a sputtering method, an EB deposition method, an electrophoretic deposition method, and a printing method, are known, for example. These methods are generally classified into thin film formation processes such as the sputtering method and the EB deposition method, and thick film formation processes such as the electrophoretic deposition method and the printing method, and the thick film formation processes are used for improving the productivity and/or reducing the cost. In the electrophoretic deposition method or the printing method, a precursor cathode layer is first formed by using a mixture of a conductive material and an insulative material, and then the precursor cathode layer is baked at a temperature higher than the softening point of a binder material included in the insulative material to form the cathode layer. Typically, as the binder material, a glass, particularly a lead glass is used in many cases in order to reduce the process temperature. Lead in the lead glass is added in order to reduce the softening point thereof.

However, the present inventors have discovered that a sufficient product lifetime cannot be ensured if a lead glass, or the like, is used as the binder material as in the prior art, even in cases where lanthanoid boride materials having a high sputtering resistance are used as the material of the cathode layer.

For example, when a lead glass is used, a lead oxide included in the lead glass has a low sputtering resistance, and is sputtered during a plasma discharge to be attached to the plasma cell substrate and/or the dielectric layer bottom surface, thereby causing a reduction of the transmittance. Moreover, since a lead oxide is readily reducible, the lead oxide attached to the dielectric layer bottom surface is easily reduced to increase the conductivity, thereby causing the busbar phenomenon.

The above-described problem is common to gas discharge display devices having discharge electrodes, and plasma display panels (PDPS) producing a display by illuminating a fluorescent layer through a plasma discharge, as well as PALCs, have the problem that a sufficient product lifetime is not ensured. In a PDP, a lead oxide included in the lead glass in the cathode layer is sputtered during a plasma discharge to be attached to a front side substrate (e.g., a glass substrate) and/or the surface of the fluorescent layer, thereby reducing the transmittance and/or the illumination efficiency of the fluorescent layer, and thus reducing the illumination brightness.

SUMMARY OF THE INVENTION

The present invention has been made in view of the problems described above, and has an object to provide a gas discharge display device, a plasma addressed liquid crystal display device, and a method for producing the same, in which the reduction of the display quality due to sputtering of the cathode layer is prevented/suppressed.

A gas discharge display device of the present invention includes a pair of substrates opposing each other, and a plurality of plasma channels provided between the pair of substrates, wherein: each of the plurality of plasma channels includes a discharge gas, an anode and a cathode; and the cathode includes a cathode layer including a conductive material and a glass having a lead weight percentage of 30% or less, thus achieving the above-described object.

It is preferred that the glass includes at least one element selected from the group consisting of sodium, lithium, potassium and bismuth.

It is preferred that the conductive material includes gadolinium hexaboride, lanthanum hexaboride, yttrium tetraboride or carbon.

The gas discharge display device may further include an additional substrate opposing one of the pair of substrates via the other one of the pair of substrates, and a liquid crystal layer provided between the other one of the pair of substrates and the additional substrate.

Each of the plasma channels may further include a fluorescent layer.

An plasma addressed liquid crystal display device of the present invention includes a first substrate, a second substrate, a dielectric layer provided between the first substrate and the second substrate, a liquid crystal layer provided between the first substrate and the dielectric layer, and a plurality of plasma channels provided between the dielectric layer and the second substrate, wherein: each of the plasma channels includes a discharge gas, an anode and a cathode; and the cathode includes a cathode layer made of a mixture of a conductive material and an insulative material including a glass having a lead weight percentage of 30% or less, thus achieving the above-described object.

Another plasma addressed liquid crystal display device of the present invention includes a first substrate, a second substrate, a dielectric layer provided between the first substrate and the second substrate, a liquid crystal layer provided between the first substrate and the dielectric layer, and a plurality of plasma channels provided between the dielectric layer and the second substrate, wherein each of the plasma channels includes a discharge gas, an anode and a cathode, the plasma addressed liquid crystal display device being produced by a method for producing a plasma addressed liquid crystal display device, the method including the steps of: providing a second substrate; forming a precursor cathode layer on the second substrate by using a mixture of a conductive material and an insulative material including a glass having a lead weight percentage of 30% or less; forming a cathode including a cathode layer obtained by baking the precursor cathode layer; forming an anode on the second substrate, the anode opposing the cathode at a predetermined interval; attaching a dielectric layer to the second substrate at a predetermined interval, and then filling a discharge gas into a gap between the second substrate and the dielectric layer, thereby forming a plurality of plasma channels; and attaching the first substrate and the dielectric layer to each other at a predetermined interval, and then injecting a liquid crystal material into a gap between the first substrate and the dielectric layer, thereby forming a liquid crystal layer, thus achieving the above-described object.

It is preferred that the glass of the insulative material includes at least one element selected from the group consisting of sodium, lithium, potassium and bismuth.

It is preferred that the conductive material includes gadolinium hexaboride, lanthanum hexaboride, yttrium tetraboride or carbon.

A method for producing a plasma addressed liquid crystal display device of the present invention is a method for producing a plasma addressed liquid crystal display device including a first substrate, a second substrate, a dielectric layer provided between the first substrate and the second substrate, a liquid crystal layer provided between the first substrate and the dielectric layer, and a plurality of plasma channels provided between the dielectric layer and the second substrate, wherein each of the plasma channels includes a discharge gas, an anode and a cathode, the method including the steps of: forming a precursor cathode layer on the second substrate by using a mixture of a conductive material and an insulative material including a glass having a lead weight percentage of 30% or less; and forming the cathode including a cathode layer obtained by baking the precursor cathode layer, thus achieving the above-described object.

It is preferred that the step of forming the precursor cathode layer is performed by using an electrophoretic deposition method.

It is preferred that the step of forming the precursor cathode layer is performed by using a printing method.

It is preferred that the glass of the insulative material includes at least one element selected from the group consisting of sodium, lithium, potassium and bismuth.

It is preferred that the conductive material includes gadolinium hexaboride, lanthanum hexaboride, yttrium tetraboride or carbon.

Functions of the present invention will now be described.

In the gas discharge display device of the present invention, the glass included in the cathode layer is a glass having a lead weight percentage (mass percentage) of 30% or less. Therefore, the amount of a lead oxide to be sputtered during a plasma discharge is reduced. As a result, the reduction of the display quality is prevented/suppressed.

Also in the plasma addressed liquid crystal display device of the present invention, the glass included in the cathode layer is a glass having a lead weight percentage (mass percentage) of 30% or less. Therefore, the amount of a lead oxide to be sputtered during a plasma discharge to be attached to the second substrate and/or the dielectric layer bottom surface is reduced. As a result, the reduction of the transmittance and the occurrence of the busbar phenomenon are suppressed.

In the method for producing a plasma addressed liquid crystal display device of the present invention, an insulative material including a glass having a lead weight percentage of 30% or less is used in the step of forming the precursor cathode layer on the second substrate. Therefore, it is possible to obtain a plasma addressed liquid crystal display device having a cathode layer in which the content of a lead oxide, having a low sputtering resistance, is reduced. As a result, the reduction of the transmittance and the occurrence of the busbar phenomenon can be suppressed.

Where a step of forming a precursor cathode layer by using an electrophoretic deposition method is employed, the precursor cathode layer is formed on the surface of the lower cathode layer by immersing the second substrate having the lower cathode layer formed thereon in a solution (electrophoretic deposition solution) having a conductive material and an insulative material being dispersed therein, and by applying a voltage to the lower cathode layer. As a result, it is possible to improve the productivity and reduce the cost as compared to when a thin film formation process such as a sputtering method or an EB deposition method is used.

Where a step of forming a precursor cathode layer by using a printing method is employed, the precursor cathode layer is formed by printing a thick film paste including a conductive material and an insulative material on the second substrate. As a result, it is possible to improve the productivity and reduce the cost as compared to when a thin film formation process such as a sputtering method or an EB deposition method is used.

The softening point of a glass is reduced by including sodium, lithium, potassium or bismuth as an oxide. By adding a component listed above in place of lead, which is included in the prior art in order to reduce the softening point, it is possible to obtain a glass having a small lead content while minimizing the increase in the softening point from that of a conventional glass.

When gadolinium hexaboride, lanthanum hexaboride, yttrium tetraboride or carbon is used as the conductive material, the cathode layer is less likely to be sputtered during a plasma discharge because the materials listed above have high sputtering resistances. As a result, it is no longer necessary to fill in mercury where nickel is used as the cathode layer, as in the prior art, whereby it is possible to suppress the reduction of transmittance or the occurrence of the busbar phenomenon even at low temperatures.

DETAILED DESCRIPTION OF THE PREFERRED EMBODIMENTS

Gas discharge display devices according to embodiments of the present invention will now be described with reference to the drawings. Note that the present invention is not limited to the following embodiments.

(Embodiment 1)

A plasma addressed liquid crystal display device (PALC) 100 according to Embodiment 1 of the present invention and a method for producing the same will be described.

Figure 1:
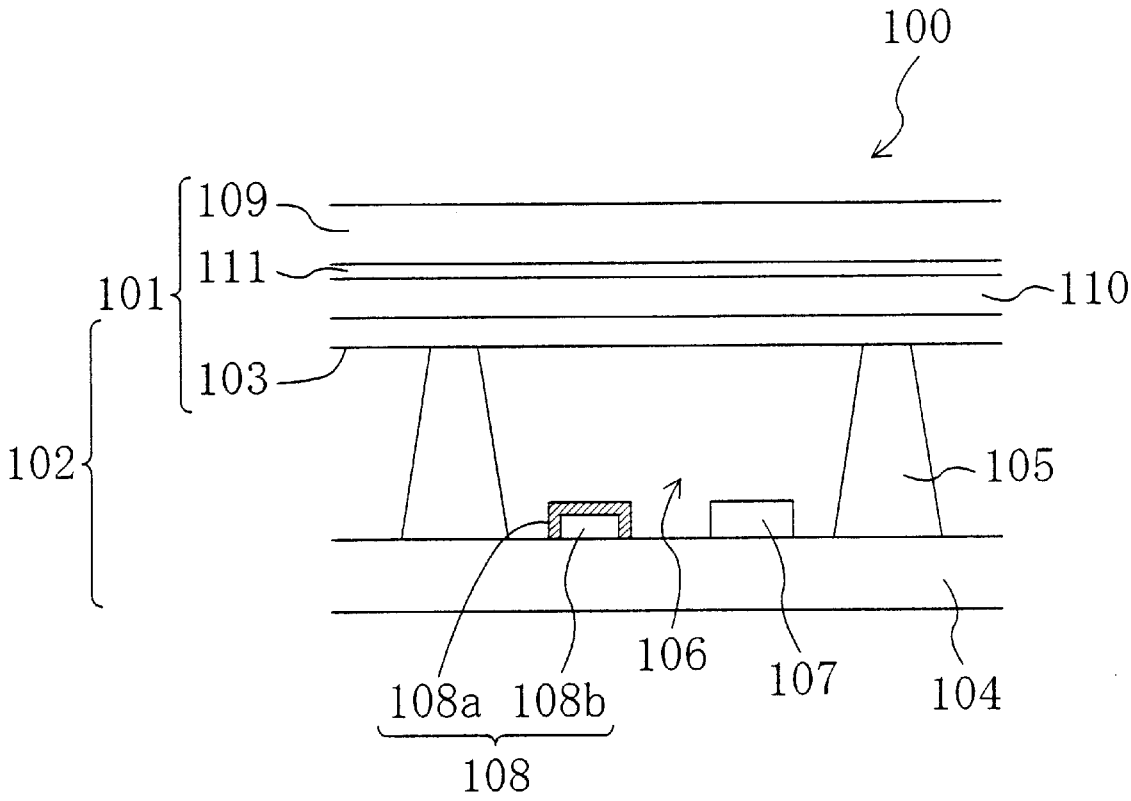
FIG. 1 is a cross-sectional view schematically illustrating a plasma addressed liquid crystal display device 100 according to Embodiment 1 of the present invention.
Figure 2:
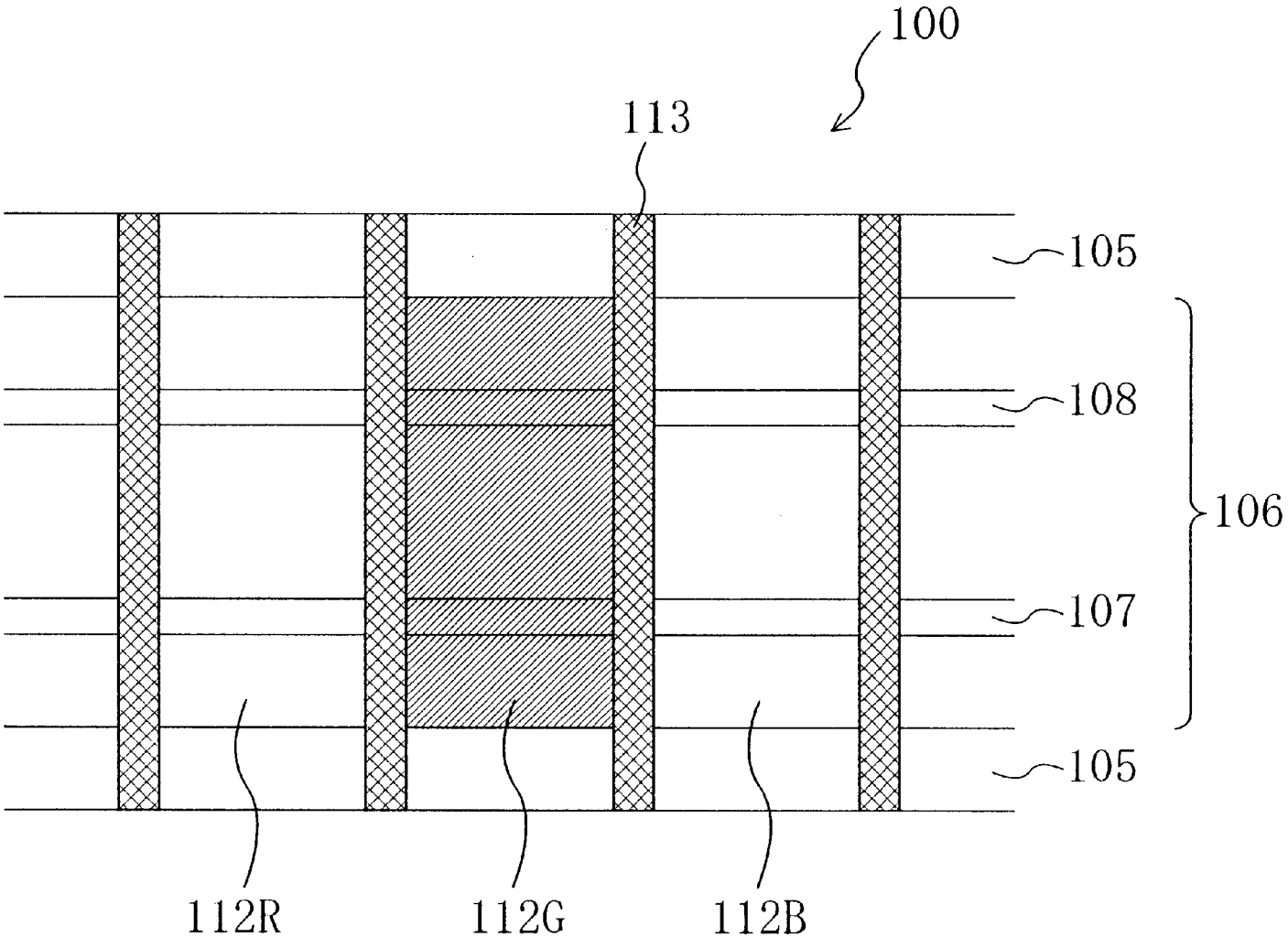
FIG. 2 is a top view schematically illustrating the plasma addressed liquid crystal display device 100 according to Embodiment 1 of the present invention.

First, the structure of the PALC 100 according to Embodiment 1 of the present invention will be described with reference to FIG. 1 and FIG. 2. FIG. 1 is a cross-sectional view schematically illustrating the PALC 100, and FIG. 2 is a plan view thereof.

The PALC 100 has a structure in which a liquid crystal cell 101 and a plasma cell 102 are layered together via a dielectric layer 103 therebetween.

The plasma cell 102 includes a plasma cell substrate 104 and the dielectric layer 103, with a plurality of partition walls 105 being arranged therebetween in a stripe pattern. A plasma channel 106 is defined as a space sealed by adjacent partition walls 105, the plasma cell substrate 104 and the dielectric layer 103, and the plasma channel 106 is filled with a discharge gas capable of being ionized through discharge. Each of the plasma channels 106 has discharge electrodes (an anode 107 and a cathode 108) formed on the plasma cell substrate 104.

The cathode 108 provided in the PALC 100 of the present embodiment has a structure in which a cathode layer **108*a* contributing to secondary electron emission during a plasma discharge is formed on the surface of a lower cathode layer 108*b* not contributing to secondary electron emission. The cathode layer 108*a* is made of a mixture of a conductive material and an insulative material including a glass having a lead weight percentage of 30% or less. Note that the arrangement of the partition walls 105, the anode 107 and the cathode 108 is not limited to that illustrated in FIG. 1 and FIG. 2**, and may alternatively be as those of the conventional plasma cells having various structures.

The liquid crystal cell 101 includes a liquid crystal cell substrate 109 and the dielectric layer 103, with a liquid crystal layer 110 being provided therebetween. On the liquid crystal layer 110 side of the liquid crystal cell substrate 109, a plurality of signal electrodes 111 in a parallel stripe pattern are formed so as to cross the plasma channels 106. Moreover, the liquid crystal cell substrate 109 includes, on the liquid crystal layer 110 side, colored layers (not shown) provided so as to correspond to the signal electrodes 111. The colored layers are typically red, green and blue layers.

As the liquid crystal layer 110, a liquid crystal layer of a TN (Twisted Nematic) mode is used, for example. Alternatively, a liquid crystal layer of an ASM (Axially Symmetric aligned Microcell) mode or a VA (Vertical Alignment) mode may be used for achieving wider viewing angles, or a liquid crystal layer of any of various conventional display modes may be used.

Figure 3:
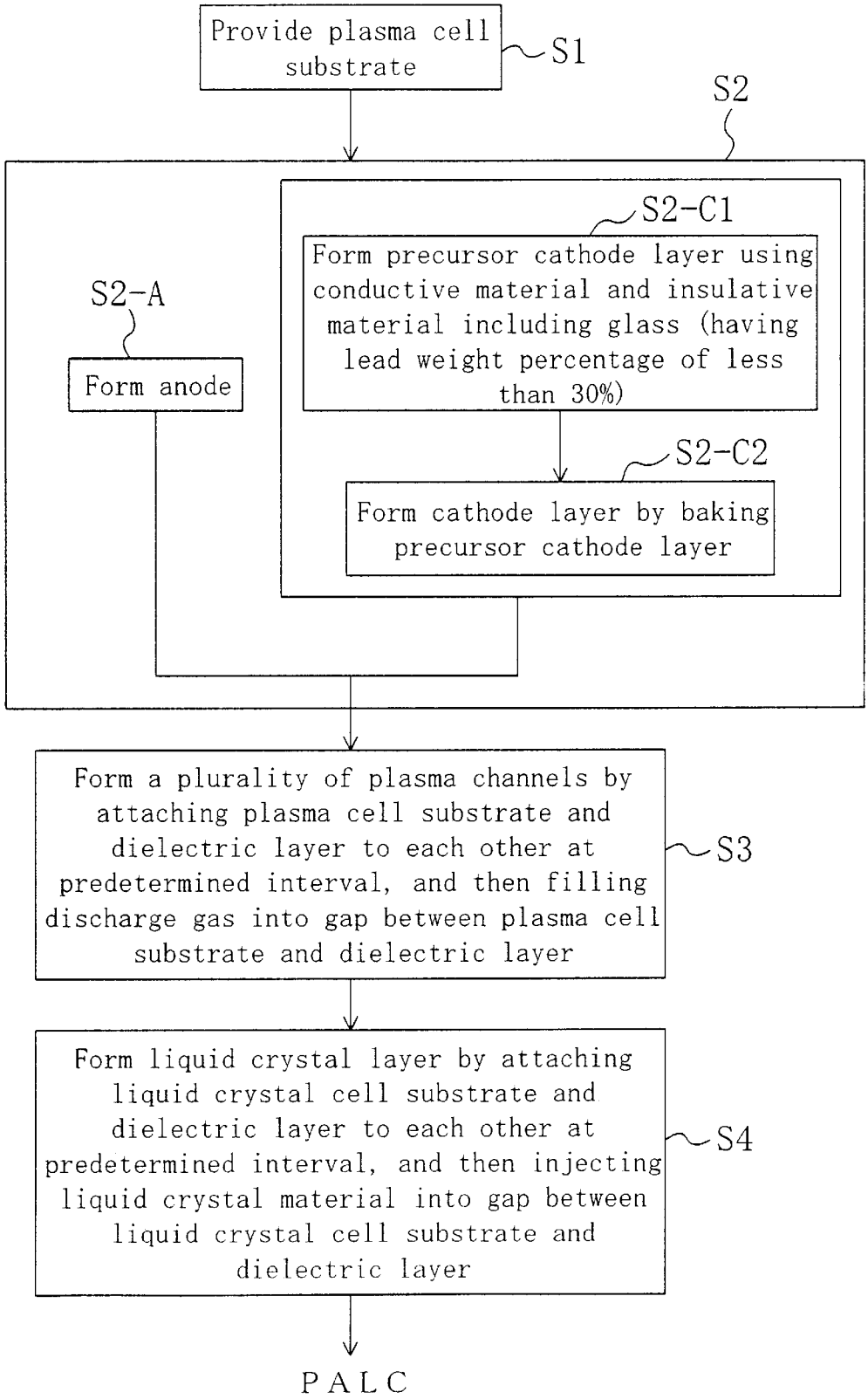
FIG. 3 is a flow chart illustrating a method for producing the plasma addressed liquid crystal display device 100 according to Embodiment 1 of the present invention.

Next, a method for producing the PALC 100 of the present embodiment will be described with reference to FIG. 1, FIG. 2 and FIG. 3. FIG. 3 is a flow chart of the method for producing the PALC 100 of the present embodiment.

First, in step S1, the plasma cell substrate 104 is provided.

Then, in step S2, discharge electrodes are formed on the plasma cell substrate 104. Specifically, the following three steps are performed in step S2. First, in step S2-C1, a precursor cathode layer is formed on the plasma cell substrate 104 by using a mixture of a conductive material and an insulative material including a glass having a lead weight percentage of 30% or less. Then, in step S2-C2, the cathode layer **108*a* is formed by baking the precursor cathode layer. Then, in step S2-A, the anode 107 opposing the cathode at a predetermined interval is formed on the plasma cell substrate 104. Note that step S2-A may be performed at any point during step S2**.

Then, in step S3, the plasma cell substrate 104 and the dielectric layer 103 are attached to each other with a predetermined interval therebetween, after which a discharge gas is filled into the gap between the plasma cell substrate 104 and the dielectric layer 103, thereby forming a plurality of plasma channels.

Then, in step S4, the liquid crystal cell substrate 109 and the dielectric layer 103 are attached to each other with a predetermined interval therebetween, after which a liquid crystal material is injected into the gap between the liquid crystal cell substrate 109 and the dielectric layer 103, thereby forming a liquid crystal layer.

The method for producing the PALC 100 of the present embodiment will now be described step by step in greater detail.

First, in step S1, the plasma cell substrate (e.g., a glass substrate) 104 is provided.

Step S2 is performed as follows, for example.

First, the lower cathode layer 108*b* and the anode 107 are formed on the plasma cell substrate 104. As the materials of the lower cathode layer 108*b* and the anode 107, any materials known as discharge electrode materials may be used, and the method for forming the lower cathode layer 108*b* and the anode 107 may be suitably selected from among known methods according to the material.

The lower cathode layer 108*b* and the anode 107 may be formed as follows by a screen printing method using a conductive paste (e.g., a nickel paste, an aluminum paste or a silver paste). Note that the conductive paste is a mixture of a conductive material and an insulative material, and includes a conductive powder (e.g., a nickel powder, an aluminum powder or a silver powder), a low melting point glass, an organic binder (e.g., an organic substance including ethyl cellulose), and a solvent (e.g., BCA (diethylene glycol mono-n-butyl ether acetate) or aterpineol). The screen printing method is a method for printing a pattern by using, for example, a screen sheet of a woven stainless mesh on which openings are formed by a resin, and by extruding the paste through the openings with a squeegee.

First, the conductive paste is screen-printed on the plasma cell substrate 104 in a parallel stripe pattern, and dried at about 100° C. to about 150° C. Then, it is baked at a temperature higher than the softening point of a low melting point glass in order to ensure the conductivity of the lower cathode layer 108*b* and the anode 107. In order to obtain a close contact among the conductive powder particles to ensure the conductivity thereof, it is necessary to perform the baking at a temperature such that the viscosity of the low melting point glass is sufficiently low, and the baking temperature is preferably higher than the softening point of the low melting point glass by 20° C. or more, and more preferably by 40° C. or more. Moreover, in order to suppress deformation (warping or distortion) of the plasma cell substrate, the baking temperature is preferably 600° C. or less, and it is more preferable to use a low melting point glass whose softening point is 560° C. or less. For example, the baking is performed at 585° C. using a low melting point glass whose softening point is 560° C. or less. The lower cathode layer 108*b* preferably has a thickness of 20 μm to 50 μm, and the anode 107 preferably has a thickness of 20 μm to 50 μm. Moreover, it is more preferred that the lower cathode layer 108*b* is formed to a suitable thickness for the method for subsequently forming the precursor cathode layer on the surface thereof. For example, in the case of subsequently forming a precursor cathode layer by using a printing method, it is preferred in view of coatability that the lower cathode layer 108*b* is formed to be thin (10 μm or less; e.g., 8 μm) by a printing method using a screen sheet having a fine mesh size (#400 or higher) and a small wire diameter.

Note that sagging of a paste influences the precision in a screen printing method, the line width limit is about 60 μm, and the positional precision error is about ±10 μm for 40-inch to 50-inch class PALCs. Therefore, in order to further improve the precision, the lower cathode layer 108*b* and the anode 107 may be formed as follows by using a sandblast method (the line width limit is about 30 μm, and the position precision error is about ±5 μm). First, a conductive paste layer is formed on the entire surface of the plasma cell substrate 104. Then, for example, a dry film resist (DFR) having a thickness of about 30 μm is attached to the conductive paste layer, and the DFR is patterned into a parallel stripe pattern. Then, the conductive paste layer is formed into a parallel strip pattern by sandblasting using the DFR as a mask, and baked to obtain the lower cathode layer 108*b* and the anode 107.

Moreover, the method described above provides an advantage that the number of steps is reduced by forming the anode 107 simultaneously with the lower cathode layer 108*b*. Of course, the step of forming the anode 107 may not be performed simultaneously with the step of forming the lower cathode layer 108*b*, and may be performed at any point during step S2.

Then, the precursor cathode layer to be the cathode layer 108*a* is formed on the surface of the lower cathode layer 108*b*.

For example, the precursor cathode layer is formed as follows using an electrophoretic deposition method.

First, the plasma cell substrate 104 is immersed in an electrophoretic deposition solution obtained by dispersing a conductive material powder and an insulative material powder including a glass having a lead weight percentage of 30% or less in an organic solvent (e.g., IPA), so as to oppose a conductive plate (e.g., a stainless plate) to be a counter electrode at an interval of about 10 mm.

It is preferred that the average particle diameter of the conductive material powder and that of the insulative material powder are made equal to each other in order to match their mobilities (the velocity at which a particle travels per unit electric field strength) with each other, and it is preferred that the particle size distribution is as narrow as possible (e.g., d50 (median value)=2 μm, d90=4 μm, d10=1 μm) in order to reduce variations in the thickness of the electrodeposited film. Moreover, small amounts of pure water and an electrolyte (e.g., magnesium nitrate) are added to the solvent in order to prevent aggregation of the particles and to cause electrophoresis.

Then, a voltage is applied between the lower cathode layer 108*b* and the counter electrode so as to cause the conductive material and the insulative material to electrically deposit on the lower cathode layer 108*b*, thereby forming the precursor cathode layer. The precursor cathode layer preferably has such a thickness (e.g., 4 μm to 10 μm) as to uniformly and sufficiently coat the lower cathode layer 108*b*. In the present embodiment, a voltage of 30 V is applied for four minutes to form a precursor cathode layer having a thickness of about 6 μm.

Alternatively, the precursor cathode layer may be formed as follows by using a printing method.

A paste having a conductive material and an insulative material including a glass having a lead weight percentage of 30% or less is printed on the surface of the lower cathode layer 108*b* by using a screen printing method so as to form a precursor cathode layer. The precursor cathode layer is preferably formed so as to completely coat the lower cathode layer 108*b*, and preferably has a thickness of 10 μm to 20 μm.

Note that in cases where the precursor cathode layer is formed by using a printing method, forming the lower cathode layer 108*b* whose electric resistance is lower than that of the cathode layer 108*a* has an advantage that the resistance in the row direction (the direction in which the plasma channels extend) is reduced, and the delay of input signals and waveform blunting are suppressed. Of course, the step of forming the lower cathode layer 108*b* may be omitted by forming the precursor cathode layer directly on the plasma cell substrate 104.

In order to ensure the electric binding of the conductive material included in the precursor cathode layer formed as described above, the precursor cathode layer is baked at a temperature higher than the softening point of the glass included in the insulative material to form the cathode layer 108*a*. In order to obtain a close contact between the conductive materials to ensure the electric binding thereof, it is necessary to perform the baking at a temperature such that the viscosity of the glass included in the insulative material is sufficiently low, and the baking temperature is preferably higher than the softening point of the glass included in the insulative material by 20° C. or more, and more preferably by 40° C. or more. Moreover, in order to suppress deformation (warping or distortion) of the plasma cell substrate, the baking temperature is preferably 600° C. or less, and it is more preferable to use a glass whose softening point is 560° C. or less as the glass included in the insulative material. In the present embodiment, the baking is performed at 585° C. using a glass whose softening point is 560° C. or less. Note that the method for forming the precursor cathode layer is not limited to the two methods described above, and may be any of various methods known in the art.

As for the conductive material included in the precursor cathode layer, while a known material having a good conductivity may be used, it is preferred that a material having a high sputtering resistance is used, and moreover it is preferred that gadolinium hexaboride, lanthanum hexaboride, yttrium tetraboride or carbon is used.

Moreover, as for the glass having a lead weight percentage of 30% or less, which is included in the precursor cathode layer, a glass of any of various compositions known in the art may be used, and it is preferred that a low melting point glass with sodium, lithium, potassium or bismuth added thereto is used.

Step S3 may be performed by a known method using a known material. For example, it is performed as follows.

First, the plurality of partition walls 105 are formed on the plasma cell substrate 104 in a stripe pattern. The partition walls 105 are formed by a screen printing method using a thick film paste, for example. The thick film paste includes a low melting point glass, a ceramic filler, an organic binder, a solvent and a black pigment. The black pigment is added in order to suppress reflection and/or scattering of light. Then, a step of screen-printing a thick film paste and then drying it at about 100° C. to about 150° C. is repeated a predetermined number of times to form the partition walls 105 to a desired height. In the present embodiment, the step is repeated about 10 times to form it to a height of about 200 μm. Then, baking is performed at a temperature (about 580° C.) that is higher than the softening point of the low melting point glass to ensure a sufficient rigidity as partitioning walls.

Then, the plasma cell substrate 104 and the dielectric layer (e.g., a thin plate glass) 103 are attached to each other by a known method using a known frit material.

Then, the plasma channels are evacuated through an evacuation pipe called "chip pipe" to bring the plasma channels into vacuum (up to $10^{-7}$ Torr (up to about $1.3\times10^{-5}$ Pa)). Then, a discharge gas is filled into the inside, and the chip pipe is heated and melted for sealing. As the discharge gas, it is preferred that xenon or a mixed gas whose main component is xenon is used. When xenon is used as the discharge gas in the PALC 100 of the present embodiment, it is possible to ensure a practical level of lifetime (10000 hours or more) by setting the gas pressure to about 20 Torr to about 40 Torr (about 2700 Pa to about 5300 Pa). Note that the discharge gas is not limited to those described above, but may be a rare gas or a mixed gas whose main component is a rare gas. The discharge gas may be suitably selected according to the material of the cathode layer so as to achieve good aging characteristics of the PALc (the reduction of transmittance being slow, the busbar phenomenon being unlikely to occur) in view of the sputtering rate and the discharge current.

Step S4 may be performed by a known method using a known material. For example, it is performed as follows.

First, the liquid crystal cell substrate (e.g., a glass substrate) 109 having the plurality of signal electrodes 111 formed thereon in a parallel stripe pattern is provided. The signal electrodes 111 are formed by a sputtering method using ITO, for example. Then, in the case of TN mode, a horizontal alignment material is applied on one side of each of the dielectric layer 103 and the liquid crystal cell substrate 109 opposing the liquid crystal layer 110, and baked at about 200° C., after which a rubbing treatment is performed. In the case of ASM mode or VA mode, a vertical alignment material is used instead of a horizontal alignment material, and the rubbing treatment does not have to be performed. Known materials may be used for the horizontal alignment material and the vertical alignment material. Note that the present invention is not limited to the display modes described above, and may be used for any of various conventional display modes. Therefore, the alignment material and the alignment treatment method may be suitably selected according to the mode to be used.

Then, the dielectric layer 103 and the liquid crystal cell substrate 109 are attached to each other using a sealant. A known material may be used for the sealant, e.g., a thermosetting resin, a UV curable resin, or a mixture thereof. At this time, a spacer is dispersed between the dielectric layer 103 and the liquid crystal cell substrate 109.

Then, a liquid crystal material is injected into the gap between the dielectric layer 103 and the liquid crystal cell substrate 109, and the injection port is sealed by using a UV curable resin, for example. As for the liquid crystal material, a known liquid crystal material having a positive dielectric anisotropy is used in the case of TN mode, and a known liquid crystal material having a negative dielectric anisotropy is used in the case of ASM mode or VA mode. Note that the present invention is not limited to the display modes described above, and may be used for any of various conventional display modes. Therefore, the liquid crystal material may be suitably selected according to the mode to be used.

The PALC 100 of the present embodiment is produced as described above.

The aging characteristics of the PDP 100 will now be described, along with those of a comparative example, in order to discuss the reliability of the PALC 100 of the present embodiment in view of the aging characteristics (the aging of the transmittance and the busbar lifetime).

Figure 6:
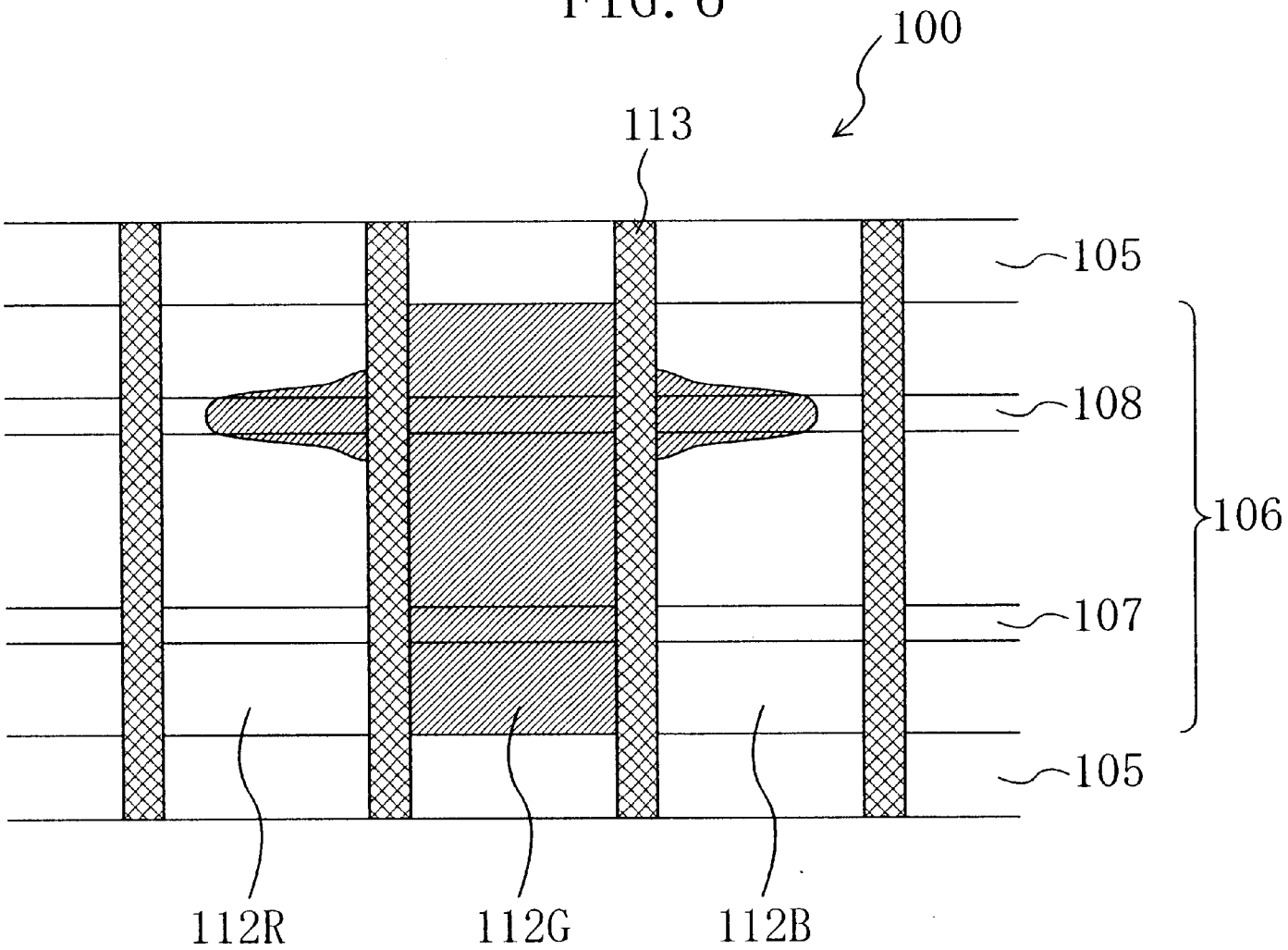
FIG. 6 is a top view schematically illustrating the plasma addressed liquid crystal display device 100 according to Embodiment 1 of the present invention.

First, the definition of the busbar lifetime will be described with reference to FIG. 6. FIG. 6 is a top view schematically illustrating the PALC 100, showing three contiguous picture element regions 112R, 112G and 112B (corresponding to red, green and blue, respectively, with a black matrix 113 formed between adjacent picture element regions) along a single plasma channel 106. The busbar lifetime is defined as a point in time when a change in the optical characteristics centered about regions of the adjacent red and blue picture element regions opposing the cathode 108 is observed while a single-color display of green is produced in the picture element regions, as illustrated in FIG. 6 (the hatching in FIG. 6 indicates that the picture element region is ON (bright state)).

Figure 4:
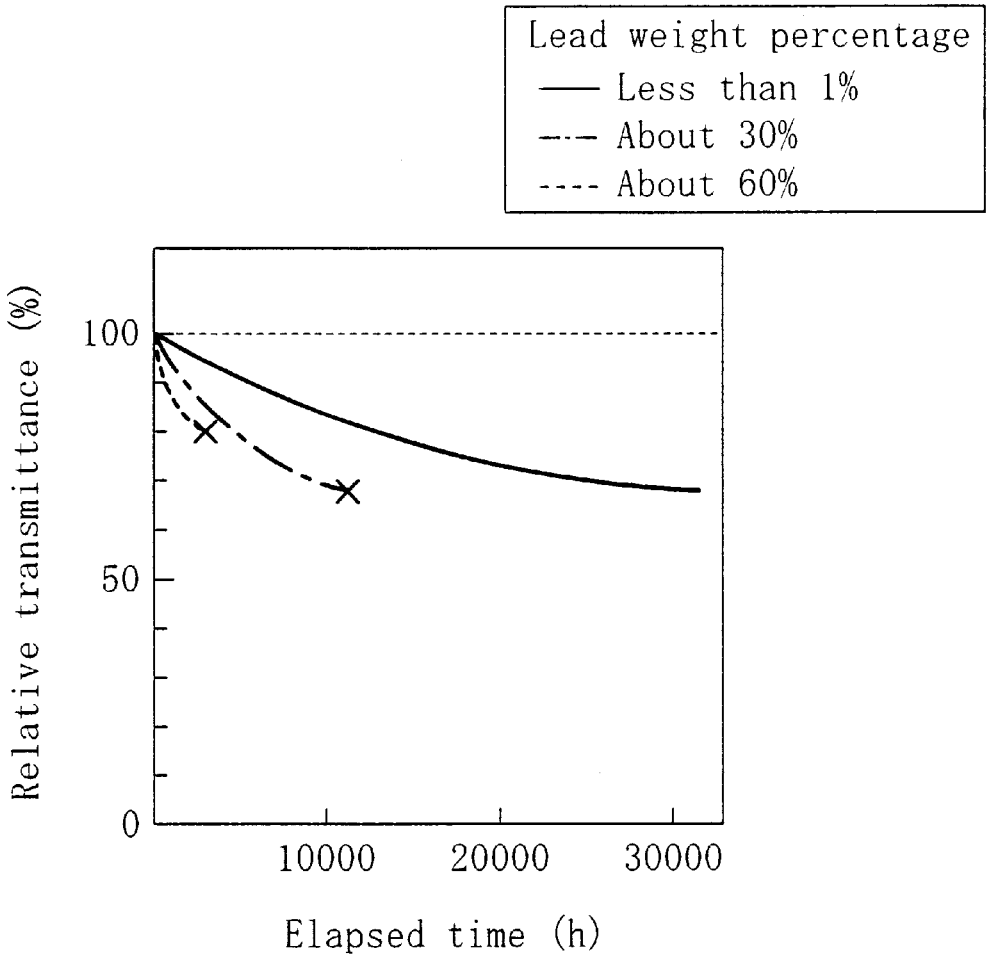
FIG. 4 is a graph illustrating the aging of the transmittance of the plasma addressed liquid crystal display device 100 according to Embodiment 1 of the present invention.
Figure 5:
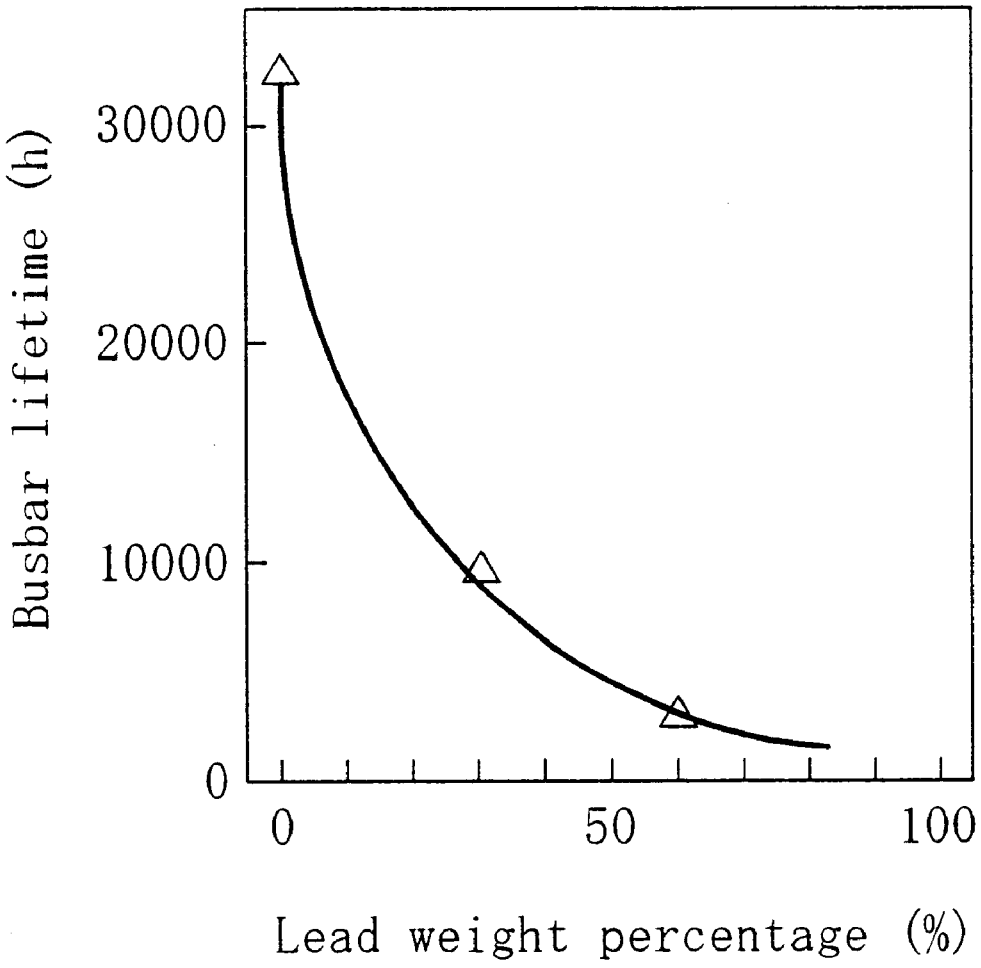
FIG. 5 is a graph illustrating a busbar lifetime of the plasma addressed liquid crystal display device 100 according to Embodiment 1 of the present invention.

Next, FIG. 4 and FIG. 5 illustrate aging characteristics of the PALC 100 while varying the lead weight percentage of the glass used in the production process of the PALC 100 of the present embodiment. Note that a rectangular wave having a period of 16.7 ms (60 Hz), a peak value of −280 V and a pulse width of 64 μs was used as the driving waveform for the aging process. FIG. 4 shows the aging of the transmittance of the PALC 100, with the vertical axis representing the relative transmittance with respect to the elapsed time along the horizontal axis, and the symbol "x" in the figure representing the occurrence of the busbar phenomenon. FIG. 5 shows the busbar lifetime of the PALC 100, with the vertical axis representing the busbar lifetime with respect to the lead weight percentage along the horizontal axis, and the symbol "Δ" in the figure representing a PALC showing the aging of the transmittance in FIG. 4. As a comparative example, the aging of the transmittance and the busbar lifetime of a PALC produced by a similar production method as that of the present embodiment except that a glass whose lead weight percentage exceeds about 30% is used are shown in the same figures. Exemplary compositions of glasses (those having lead weight percentages of less than 1%, about 30% and about 60%) used in the production process of the PALCs shown in FIG. 4 and FIG. 5 are shown in Table 1.

TABLE 1

| Lead weight percentage | |
|---|---|
| Less than 1% | ZnO, $B_2O_3$, $SiO_2$, $Al_2O_3$, $Na_2O$ (in the case of alkaline type) |
| | $Bi_2O_3$, ZnO, $B_2O_3$, $SiO_2$, $Al_2O_3$ (in the case of bismuth type) |
| About 30% | $Bi_2O_3$, PbO, $B_2O_3$, $SiO_2$ |
| About 60% | PbO, $B_2O_3$, $SiO_2$, $Al_2O_3$ |

In the prior art, a glass having a lead weight percentage of about 60% to about 80% is used in many cases as the binder material in the insulative material in order to reduce the process temperature (baking temperature). However, in a PALC produced by using a glass having a lead weight percentage of about 60% to about 80%, the transmittance decreases rapidly and the busbar lifetime expires early as illustrated in FIG. 4 and FIG. 5. For example, in a PALC produced by using a glass having a lead weight percentage of about 60%, the relative transmittance decreases to about 80% and the busbar lifetime expires after about 3000 hours as illustrated in FIG. 4 and FIG. 5.

In contrast, the PALC 100 of the present embodiment produced by using a glass having a lead weight percentage of about 30% or less has a practical level of aging characteristics (the busbar lifetime is 10000 hours or more) as illustrated in FIG. 4 and FIG. 5. For example, when the lead weight percentage is about 30%, the relative transmittance decreases to about 80% after about 5000 hours, and the busbar lifetime expires after passage of about 10000 hours. Moreover, when the lead weight percentage is less than 1%, the relative transmittance decreases to about 80% after about 15000 hours, and the busbar lifetime does not expire even after passage of 30000 hours, indicating that the PALC 100 has even better aging characteristics.

As illustrated in FIG. 4 and FIG. 5, as the lead weight percentage is smaller, the reduction of the transmittance is slowed down, and the busbar lifetime is prolonged, with the busbar lifetime being longest when the lead weight percentage is less than or equal to its detection limit. Moreover, as the lead weight percentage is smaller, the transmittance upon expiration of the busbar lifetime decreases. In other words, with the rate of transmittance decrease being equal, the occurrence of the busbar phenomenon is more delayed as the lead weight percentage is smaller.

As described above, in the PALC 100 of the present embodiment, the precursor cathode layer is formed by using a glass having a lead weight percentage of 30% or less, and the PALC 100 has a cathode layer in which the content of a lead oxide, having a low sputtering resistance, is reduced. Therefore, the amount of a lead oxide sputtered during a plasma discharge to be attached to the plasma cell substrate and/or the dielectric layer bottom surface is reduced. As a result, the reduction of the transmittance is suppressed.

Moreover, since the amount of a lead oxide attached to the dielectric layer bottom surface is reduced, the amount of lead produced through reduction of the lead oxide by discharge gas ions is also reduced necessarily. As a result, the occurrence of the busbar phenomenon is suppressed. This will be described with reference to FIG. 2 and FIG. 6.

FIG. 2 and FIG. 6 are top views schematically illustrating the PALC 100, schematically showing the three contiguous picture element regions 112R, 112G and 112B (corresponding to red, green and blue, respectively, with the black matrix 113 formed between adjacent picture element regions) along a single plasma channel 106. When a single-color display of green, for example, is produced in the picture element regions, a predetermined amount of charge is first induced in a region of the dielectric layer bottom surface corresponding to the green picture element region 112G. If the amount of the conductive substance (lead produced through reduction of the lead oxide) attached to the dielectric layer bottom surface is small, the amount of charge diffused via the conductive substance in the direction along the cathode is small. Therefore, the amount of charge distributed in regions of the dielectric layer bottom surface corresponding to the picture element regions 112R and 112B beyond the region of the dielectric layer bottom surface corresponding to the picture element region 112G is small. Thus, the liquid crystal layer in the picture element regions 112R and 112B is not substantially subject to the influence of the electric field (voltage) produced by the induced charge, and the orientation of the liquid crystal layer in the picture element regions 112R and 112B does not substantially change. As a result, a single-color display of green is produced in a desirable manner as illustrated in FIG. 2 (the hatching in FIG. 2 indicates that the picture element region is ON (bright state)), and the change in the optical characteristics (the busbar phenomenon) as illustrated in FIG. 6 (the hatching in FIG. 6 indicates that the picture element region is ON (bright state)) is not visually observed over a long-term use.

An advantage obtained when a glass with sodium, lithium, potassium or bismuth added thereto is used as the glass having a lead weight percentage of 30% or less will now be described.

The softening point of a glass is reduced by including a component listed above as an oxide. Therefore, by adding a component listed above in place of lead, which is included in the prior art in order to reduce the softening point, it is possible to obtain a glass having a small lead content while minimizing the increase in the softening point from that of a conventional glass. While the softening point of a conventional low melting point glass containing lead is about 420° C. to about 500° C., the softening point of a glass with sodium, lithium or potassium added thereto is about 540° C., and the softening point of a glass with bismuth added thereto is about 420° C. to about 500° C. Therefore, when a glass with a component listed above added thereto is used as the glass having a lead weight percentage of 30% or less, it is possible to bake the precursor cathode layer at a temperature as those in the case of using a conventional glass. As a result, it is possible to suppress the deformation (warping or distortion) of the plasma cell substrate, which is caused when the precursor cathode layer is baked at a higher temperature than in the prior art.

Moreover, while sodium, sodium, lithium, potassium or bismuth is included in a glass as an oxide, an oxide of these elements is less reducible than a lead oxide. The reducibilities of different substances can be compared by the standard Gibbs energy of formation ($\Delta Gf^0$), and a substance is less reducible as the value of $\Delta Gf^0$ is smaller. Table 2 shows the standard Gibbs energy of formation ($\Delta Gf^0$) of each of the oxides of the elements listed above and a lead oxide.

TABLE 2

| | $\Delta Gf^0$ (kJ/mol) |
|---|---|
| Lithium oxide | −561.2 |
| Sodium oxide | −375.5 |
| Potassium oxide | −361.5 |
| Bismuth oxide | −493.7 |
| Lead oxide | −187.9 |

As shown in Table 2, oxides of the elements listed above have smaller values of ÄGf$^0$ than that of a lead oxide, indicating that they are less reducible. Therefore, even when an oxide of an element listed above added in place of lead is sputtered and attached to the dielectric layer bottom surface, it is less likely to increase the conductivity because it is less reducible than a lead oxide, and thus less likely to cause the busbar phenomenon.

Moreover, even when a conductive substance (e.g., lead produced through reduction of the lead oxide or the conductive material of the cathode layer) is sputtered and attached to the dielectric layer bottom surface, if an oxide of these elements (an oxide of sodium, lithium, potassium or bismuth) is similarly sputtered and attached to the dielectric layer bottom surface to be mixed into the conductive substance, the oxide, which is less reducible and has a low conductivity, functions as an insulator and inhibits the conductivity. As a result, in the PALC 100 using a glass with sodium, lithium, potassium or bismuth added thereto, the busbar phenomenon is less likely to occur even when the transmittance decreases at a rate as that of a PALC using a conventional glass.

When gadolinium hexaboride, lanthanum hexaboride, yttrium tetraboride or carbon is used as the conductive material, the cathode layer is less likely to be sputtered during a plasma discharge because these materials have a higher sputtering resistance than that of nickel. As a result, it is no longer necessary to fill in mercury where nickel is used as the cathode layer, as in the prior art, whereby it is possible to suppress the reduction of transmittance or the occurrence of the busbar phenomenon even at low temperatures.

Moreover, when the precursor cathode layer is formed by using an electrophoretic deposition method or a printing method, it is possible to improve the productivity and reduce the cost as compared to when a thin film formation process such as a sputtering method or an EB deposition method is used.

(Embodiment 2)

Figure 7:
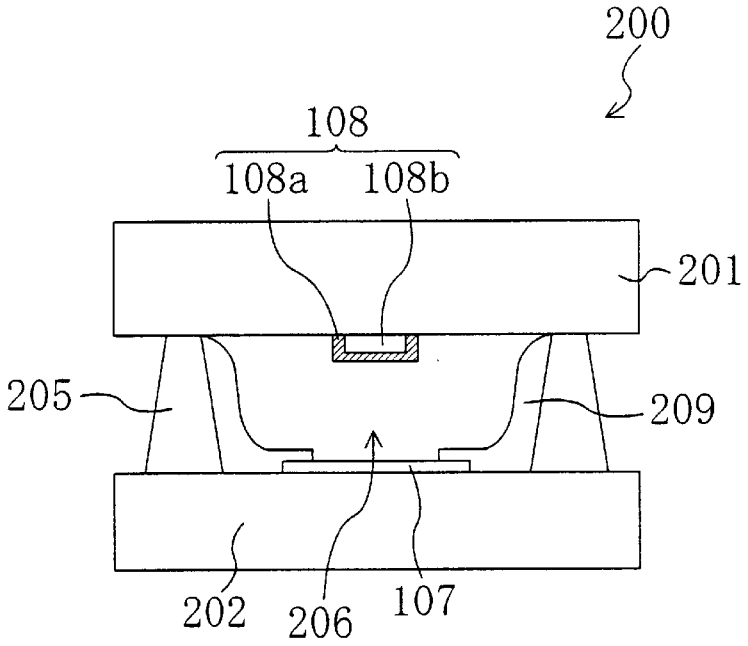
FIG. 7 is a cross-sectional view schematically illustrating a plasma display panel 200 according to Embodiment 2 of the present invention.
Figure 8:
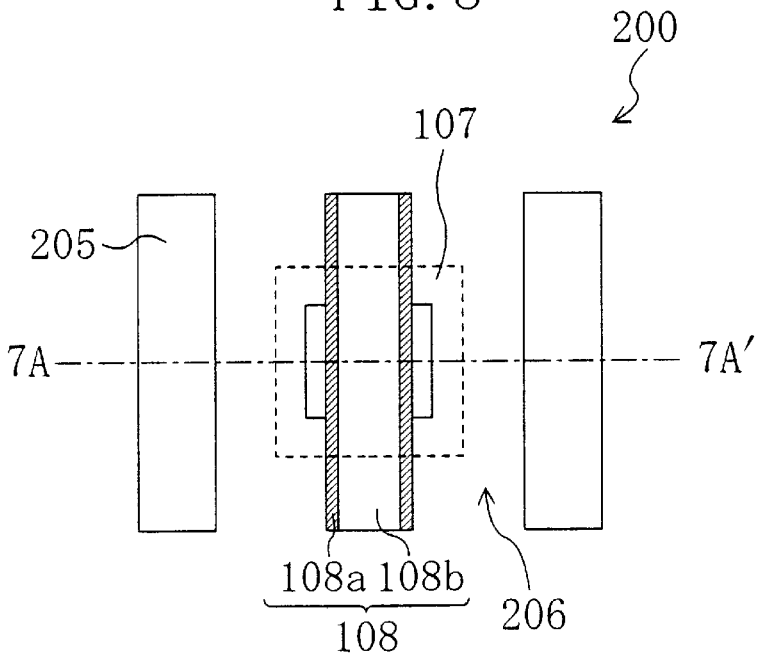
FIG. 8 is a top view schematically illustrating the plasma display panel 200 according to Embodiment 2 of the present invention.

A plasma display panel (PDP) 200 according to Embodiment 2 of the present invention will be described with reference to FIG. 7 and FIG. 8. FIG. 7 is a cross-sectional view schematically illustrating the PDP 200, and FIG. 8 is a top view thereof. FIG. 7 is a cross-sectional view taken along line 7A–7A' in FIG. 8.

The PDP 200 includes a front-side substrate 201 and a rear-side substrate 202 opposing the front-side substrate 201, with a plurality of partition walls 205 being arranged therebetween in a stripe pattern. A plasma channel 206 is defined as a space sealed by adjacent partition walls 205, the front-side substrate 201 and the rear-side substrate 202, and the plasma channel 206 is filled with a gas (e.g., a mixed gas of He and Xe or a mixed gas of Ne and Xe) capable of being ionized through discharge. Each of the plasma channels 206 has discharge electrodes including the anode 107 formed on the rear-side substrate and the cathode 108 formed on the front-side substrate.

A fluorescent layer 209 is formed on the side surface of the partition walls 205 and the surface of the rear-side substrate 202. The fluorescent layer 209 is typically a red fluorescent layer, a green fluorescent layer or a blue fluorescent layer. The fluorescent layer 209 is formed by using a fluorescent material which is excited to emit light by a UV radiation. In the PDP 200, a UV radiation generated during a plasma discharge is used to cause the fluorescent layer 209 to emit light so as to illuminate predetermined picture element regions, thereby producing a display.

The cathode 108 of the PDP 200 of the present embodiment has a structure in which the cathode layer **108*a* contributing to the secondary electron emission during a plasma discharge is formed on the surface of the lower cathode layer 108*b* not contributing to secondary electron emission. The cathode layer 108*a*** includes a conductive material and a glass having a lead weight percentage of 30% or less.

The PDP 200 of the present embodiment as described above can be produced as follows, for example.

First, the rear-side substrate (e.g., a glass substrate) 202 is provided. Then, the anode 107 is formed on the rear-side substrate 202. As the material of the anode 107, a material known as a material of a discharge electrode may be used. In view of achieving a reduction in resistance, it is preferred that silver, an alloy including silver, or aluminum is used. As the method for forming the anode 107, a screen printing method may be used, or a thin film formation process such as a sputtering method or an EB deposition method may be used, for example. Note that an alternative structure may further include a bus line made of a material different from that of the anode 107. When a bus line is provided, a resistor made of ruthenium oxide, or the like, may be further provided between the cathode 108 and the bus line in order to limit the current.

Successively, the partition walls 205 are formed on the rear-side substrate 202. A known material may be used as the material of the partition walls 205. The partition walls 205 are formed by, for example, depositing a thick film paste in a predetermined pattern by using a screen printing method. Alternatively, the partition walls 205 may be formed as follows. First, a layer of a predetermined material is formed on the entire surface of the rear-side substrate 202 by solid printing. Then, a DFR (Dry Film Resist) is attached on the layer, and exposed and developed, after which the layer is patterned into a predetermined pattern by using a sandblast method. In this way, the partition walls 205 can be formed more precisely.

Then, the fluorescent layer 209 is formed on the side surface of the partition walls 205 and the surface of the rear-side substrate 202. As the method for forming the fluorescent layer 209, a screen print method may be used, for example. When forming the fluorescent layer 209, openings are provided in the fluorescent layer 209 so as to expose portions of the anode 107 in order to allow a DC discharge to occur between the anode 107 provided on the rear-side substrate and the cathode 108 provided on the front-side substrate. In the present embodiment, the fluorescent layer 209 is a red fluorescent layer (e.g., $YBO_3$: Eu layer), a green fluorescent layer (e.g., $Zn_2SiO_4$: Mn layer) or a blue fluorescent layer (e.g., $BaMgAl_{10}O_{17}$: Eu layer) formed in a stripe pattern.

Then, the front-side substrate (e.g., a glass substrate) 201 is provided. Successively, the base cathode layer 108*b* is formed on the front-side substrate 201. In the present embodiment, the base cathode layer 108*b* is formed as follows. First, a photosensitive silver paste is applied on the entire surface of the front-side substrate 201, and exposed and developed by using a photomask so as to pattern the paste into a predetermined pattern. Then, baking is performed to form the base cathode layer 108*b* having a thickness of about 4 $\mu$m. When the base cathode layer 108*b* is formed as described above by using a photosensitive silver paste, it is easy to reduce the line width.

Then, a precursor cathode layer, to be the cathode layer 108*a,* is formed so as to cover the lower cathode layer 108*b.* The precursor cathode layer is formed as follows by using an electrophoretic deposition method, for example. First, the front-side substrate 201 is immersed in an electrophoretic deposition solution obtained by dispersing a conductive material powder and an insulative material powder including a glass having a lead weight percentage (mass percentage) of 30% or less in an organic solvent (e.g., IPA), so as to oppose a conductive plate to be a counter electrode. Then, a voltage is applied between the lower cathode layer 108*b* and the counter electrode (conductive plate) so as to cause the conductive material and the insulative material to electrically deposit on the lower cathode layer 108*b,* thereby forming the precursor cathode layer. Then, the precursor cathode layer is baked to form the cathode layer 108*a*. In the present embodiment, the cathode layer 108*a* is formed so that the thickness thereof is about 8 $\mu$m.

Finally, the front-side substrate 201 and the rear-side substrate 202 are attached to each other by using a frit material, and evacuated through an evacuation pipe called "chip pipe" to bring the plasma channels into vacuum, after which a discharge gas is injected into the plasma channels and the plasma channels are sealed.

The PDP 200 of the present invention is produced as described above.

In the PDP 200 according to the embodiment of the present invention, the cathode layer 108*a* includes a conductive material and a glass having a lead weight percentage of 30% or less, thereby reducing the content of a lead oxide, having a low sputtering resistance. Therefore, the amount of a lead oxide to be sputtered during a plasma discharge to be attached to the front-side substrate 201 and/or the surface of the fluorescent layer 209 is reduced. As a result, the reduction of the transmittance and/or the illumination efficiency of the fluorescent layer are suppressed, thereby suppressing the reduction of the illumination brightness.

Figure 9:
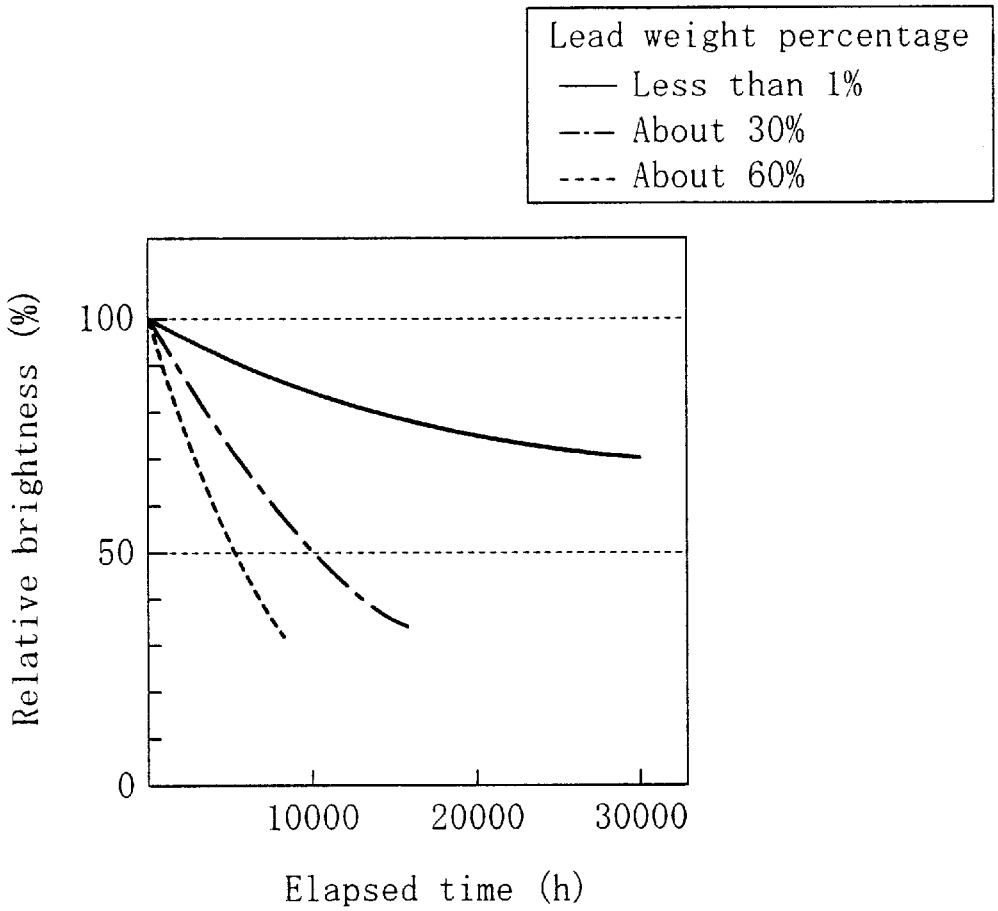
FIG. 9 is a graph illustrating the aging of the illumination brightness of the plasma display panel 200 according to Embodiment 2 of the present invention.

FIG. 9 illustrates the aging of the illumination brightness of the PDP 200 when the weight percentage of lead included in the glass in the cathode layer 108*a* of the PDP 200 of the present embodiment is changed to less than 1% and to about 30%. As a comparative example, the figure also illustrates the aging of the illumination brightness of a PDP having a structure as that of the PDP 200 except that the lead weight percentage of the glass is about 60%. Note that in FIG. 9, the vertical axis represents the relative brightness with respect to the elapsed time along the horizontal axis.

As illustrated in FIG. 9, the illumination brightness decreases more quickly as the lead weight percentage is higher. When the lead weight percentage is about 60%, the product lifetime is less than 10000 hours, with the product lifetime of a PDP being defined as a point in time when the relative brightness thereof becomes 50%. In contrast, when the lead weight percentage is about 30% or less, the product lifetime exceeds 10000 hours, and when the lead weight percentage is less than 1%, the product lifetime does not expire even after passage of 30000 hours, at which point the relative brightness remains to be about 70% or more.

As described above, in the gas discharge display device of the present invention, the cathode layer includes a conductive material and a glass having a lead weight percentage of 30% or less, thereby suppressing the reduction of the display quality.

According to the present invention, there is provided a gas discharge display device and a plasma addressed liquid crystal display device with a high reliability, which have a cathode layer with a reduced lead content and in which the reduction of the display quality due to sputtering of the cathode layer is prevented/suppressed. Moreover, according to the present invention, there is provided a method for efficiently producing such a plasma addressed liquid crystal display device.

What is claimed is:

1. A gas discharge display device comprising:

a pair of substrates opposing each other, and a plurality of plasma channels provided between the pair of substrates, wherein:

at least one of the plurality of plasma channels includes a discharge gas, an anode and a cathode; and the cathode includes a cathode layer including a conductive material and a glass comprising lead, wherein the glass has a lead weight percentage of 30% or less.

2. The gas discharge display device of claim 1, wherein the glass includes at least one element selected from the group consisting of sodium, lithium, potassium and bismuth.

3. The gas discharge display device of claim 1, wherein the conductive material includes gadolinium hexaboride, lanthanum hexaboride, yttrium tetraboride or carbon.

4. The gas discharge display device of claim 1, further comprising an additional substrate opposing one of the pair of substrates via the other one of the pair of substrates, and a liquid crystal layer provided between the other one of the pair of substrates and the additional substrate.

5. The gas discharge display device of claim 1, wherein each of the plasma channels further includes a fluorescent layer.

6. The gas discharge display device of claim 1, wherein the device is a plasma addressed liquid crystal display.

7. A gas discharge display device comprising:

a pair of substrates opposing each other, and a plurality of plasma channels provided between the pair of substrates, wherein:

at least one of the plasma channels includes a discharge gas, an anode and a cathode;

said cathode includes a layer comprising a conductive material and a glass including lead; and a lead weight percentage of the glass is 30% or less.

8. A gas discharge display device comprising:

a pair of substrates opposing each other, and a plurality of plasma channels provided between the pair of substrates, wherein:

at least one of the plurality of plasma channels includes a discharge gas, an anode and a cathode;

said cathode includes a cathode layer comprising a conductive material and a glass including lead; and a lifetime of a busbar is 10,000 hours or more.

* * * * *